United States Patent [19]

Lee et al.

[11] Patent Number: 4,800,246

[45] Date of Patent: Jan. 24, 1989

[54] DEVICE FOR PROTECTING THE TURNTABLE SHAFT OF MICROWAVE OVENS FROM THE CONCENTRATION OF MICROWAVES

[75] Inventors: Eon H. Lee; Seok W. Chin, both of Busan, Rep. of Korea

[73] Assignee: Goldstar Co., Ltd., Seoul, Rep. of Korea

[21] Appl. No.: 113,476

[22] Filed: Oct. 28, 1987

[30] Foreign Application Priority Data

Oct. 28, 1986 [KR] Rep. of Korea ..... 9049/1986

[51] Int. Cl.[4] ..... H05B 6/78

[52] U.S. Cl. ..... 219/10.55 F; 219/10.55 D

[58] Field of Search ..... 219/10.55 F, 10.55 D, 219/10.55 E; 174/35 R

[56] References Cited

U.S. PATENT DOCUMENTS 4,211,909 7/1980 Yoshida et al. ..... 219/10.55 F
4,591,682 5/1986 Takeuji ..... 219/10.55 F
4,595,827 6/1986 Hirai et al. ..... 219/10.55 F X

*Primary Examiner*—Philip H. Leung
*Attorney, Agent, or Firm*—Birch, Stewart, Kolasch & Birch

[57] ABSTRACT

A device for protecting a turntable shaft in a microwave oven to prevent the turntable shaft, which is made out of a resinous material, from fusing during the operation of the microwave oven. A protective plate is formed on the lower surface of the turntable in such a manner that a supplementary cavity is formed having its impedance at a maximum at its inlet and a choke cavity is formed having its impedance at a minimum at its inlet. The phenomenon of microwaves concentrating around the shaft is eliminated by fixing the exact dimensional range of both cavities in accordance with the characteristics of the microwaves used.

7 Claims, 2 Drawing Sheets

DEVICE FOR PROTECTING THE TURNTABLE SHAFT OF MICROWAVE OVENS FROM THE CONCENTRATION OF MICROWAVES

BACKGROUND OF THE INVENTION

The present invention relates to a device for protecting a turntable shaft of a microwave oven, and particularly to a device for preventing a turntable shaft formed out of resinous material from fusing when the microwave oven is operating.

In the conventional microwave oven, as shown in FIG. 1, the turntable 12 is installed on the base plate 11 of the heating chamber in the main body of the microwave oven. The food to be cooked is put on the turntable and heated uniformly by the microwave. The rotating shaft 13 which is fixed to the turntable 12 and mounted rotatably on the base plate 11 of the heating chamber is normally made from resinous material.

When using the conventional device, problems arise when the shaft 13 made of resinous material is heated by the microwave during the heating of the food. The problems are that the shaft 13 fuses, or sparks occur around the shaft 13 of the base plate 11 in the heating chamber, and the like.

In the conventional microwave oven, no device for protecting the turntable shaft 13 has been used, or a metal intercepting plate 14 has been fixed around the shaft 13 to prevent microwaves from concentrating in the zone of the shaft 13.

However, since the characteristics of the microwaves have not been considered up to now, the intercepting plate 14 has been shaped in a simple cylindrical form making it impossible to fundamentally eliminate the concentrating of microwaves in the zone around the shaft 13. Also a defect in the intercepting plates causes the intercepting plate 14 to perform unsatisfactorily the function of preventing the microwave from being absorbed into the shaft 13. Therefore, to avoid the problems, the conventional microwave oven requires that the shaft 13 be molded out of expensive resinous material, and thereby increasing the cost of the products.

SUMMARY OF THE INVENTION

The invention is conceived for the purpose of eliminating the above-mentioned disadvantages and the primary objective of the present invention is to provide a microwave oven where the shaft may be molded out having cheap resinous material of low thermal resistance with the microwave oven still being used safely.

The present invention, having such an objective, provides a device for protecting the turntable shaft of the microwave oven in which a protecting plate is formed at the bottom of the turntable in such a manner that a supplementary cavity has its maximum impedance at the inlet and a choke cavity has its minimum impedance at the inlet, thereby the phenomenon of the microwaves concentrating around the shaft is eliminated by determining the exact dimensional range of both the supplementary and choke cavities in accordance with characteristics of the microwaves used.

BRIEF DESCRIPTION OF THE DRAWINGS

Embodiments of the invention will now be described in more detail, by way of example, with reference to the accompanying drawings. In the drawings.

DETAILED DESCRIPTION OF THE INVENTION

Figure 1:
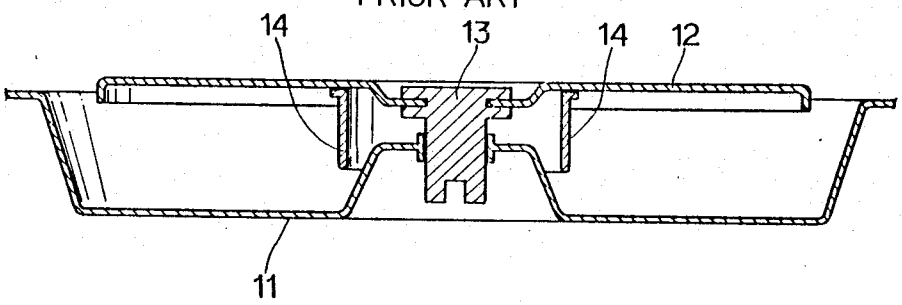
FIG. 1 PRIOR ART
FIG. 1 is a longitudinal sectional view of the conventional microwave.
Figure 2:
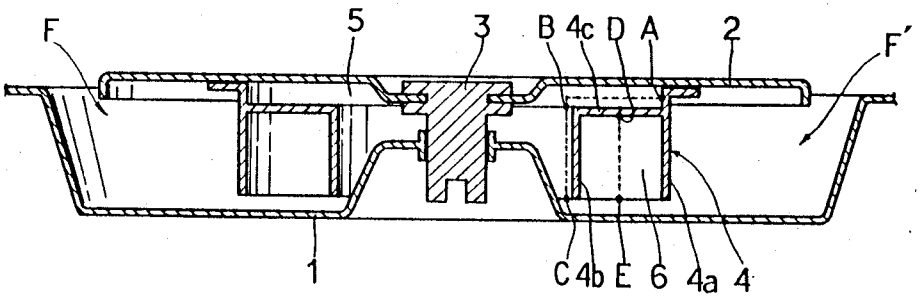
FIG. 2 is a longitudinal sectional view according to an embodiment of the present invention.

FIG. 2 is a longitudinal sectional view showing a construction according to an embodiment of the present invention, in which 1 represents the base plate of the heating chamber composing the main body of the microwave oven. Reference numeral 2 represents a turntable mounted on the base plate 1 of the heating chamber, and the mode of resinous material which is fixed to the middle of the turntable 2 is mounted rotatably on the base plate 1 of the heating chamber. A driving shaft from a separate drive source is connected to the lower end of the shaft 3, which is not shown in the drawing, causing the shaft 3 to be rotated by the drive source when the microwave oven is operating, so that the turntable 2 rotates. On the upper surface of the turntable 2 is put a vessel containing food can be put, and during the operation of the microwave oven, that is, at the time of cooking, the vessel rotates on the turntable 2 so that the food is heated uniformly by the microwave emitted into the heating chamber.

On the lower surface of the said turntable 2, the perpendicular planes **4*a* and, 4*b* and protective plate 4 having a horizontal plane 4*c* are fixedly mounted in an annular manner all around the shaft 3, and in the inner part of the perpendicular planes and 4*b* and horizontal plane 4*c* of the protective plate 4 a supplementary cavity 6 is formed and on the side of the shaft 3 from the horizontal plane 4*c* and perpendicular plane 4*b*, a choke cavity 5** is formed.

Considering the characteristics of the microwave, it is important to determine the distance between the points A, B, C, D, and E of the choke and supplementary cavities 5 and, 6 as follows:

It is assumed that $\overline{AB} \approx \lambda/4$ and $\overline{BC} \approx \lambda/4$ so that the distance from the point A to the point C comes to about $\lambda/2$ and $\overline{DE} \approx \lambda/4$.

This aspect present invention will be described more specifically with reference to FIG. 4 which shows the impedance of the microwave guide system.

Figure 4:
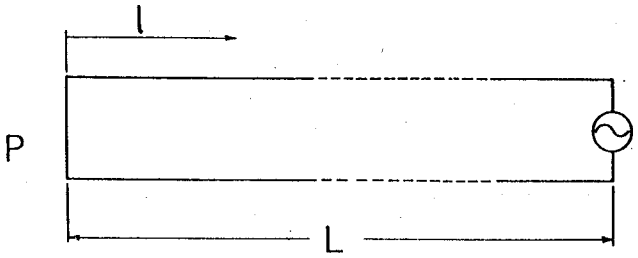
FIG. 4 is a diagram for explaining the impedance of the wave guide system.

In FIG. 4, at the distance l represents any point from the short circuit plane P. In the microwave guide the whole length is L and the characteristic impedance of which is Zo. The impedance of any point is represented by the following equation (1):

$$Zl = j.Zo.\ \tan Bl \qquad (1)$$

wherein, j: $\sqrt{-1}$

Zo: characteristic impedance $\beta$: propagation constant $(2\pi/\lambda)$ $\lambda$: wave length of the microwave used as the energy source When the equation (1) is solved using $\lambda$, the following equation is obtained: $Zl = j.\ Zo.\ \tan 2\pi l/\lambda$ That is, Zl is a function of tangent.

$$Zl \propto \tan 2\pi l/\lambda \qquad (2)$$

In the equation (2), the point at which Zl becomes the minimum, is when tan $2\pi l/\lambda$ becomes the minimum. With that knowledge, it is possible to find l as follows:

$$l=0, \pm\lambda/2, \pm\lambda, +3/2\lambda \ldots n/2\lambda (n\text{: constant})$$

But l must be a positive number, $l=0, \lambda/2, \lambda, 3/2\lambda \ldots N/2\lambda$(N: positive number)

In other words, it turns out that the impedance is minimal at the point on which the distance from the short circuit plane P, including the short circuit plane P, is $\lambda/2$, $\lambda$, etc.

It is known in microwave engineering that the microwave reflects at the point in its traveling path where the impedance is the lowest and passes through the point where the impedance is high.

According to the present invention, the distance from a point A to a point C is $\lambda/2$ and thus the impedance at the point C, which is the inlet part of the choke cavity 5, becomes the minimum, as described with reference to FIG. 4. Consequently, the microwave is reflected at the point C, and the microwave energy will not travel into the choke cavity 5.

The value of electric current is 0 at the point B when the distance from the point C to the point B in the upper part of the shaft 3 is about $\lambda/4$, so that no microwave energy travels in the direction of the shaft 3 and no effects from the microwave reaches to the shaft 3.

Since the distance from the point D corresponding to the short circuit plane P to the point E is fixed as approximate $\lambda/4$, the impedance is increased at the point E. The microwave is absorbed at the point D rather than at the point C, so that the microwave penetration into the choke cavity 5 is effectively prevented.

According to the conventional microwave oven, problems arise since the microwaves travel in the directions shown by an F' during cooking cycle and concentrate around the shaft 3 made of resinous material. This phenomenon causes the shaft 3 to partially fuse and sparks to occur around the shaft 3. This problem causes the shaft 3 to become deformed, thereby preventing the turntable 2 from rotating smoothly. To prevent such disadvantages, the shaft had to be molded 3 out of expensive resin having high thermal resistance, as mentioned above. According to the present invention, however, the microwaves are reflected at the inlet part of the choke cavity 5 formed by the protective plate 4, and the microwaves are absorbed in the protective plate 4 through the supplementary cavity 6, so that the microwaves are prevented from concentrating around the shaft 3.

Accordingly, an application of an embodiment of the present invention has the advantages that it is possible to completely eliminate the phenomenon of the turntable shaft fusing, when the microwave oven is operating in an unload state, or when the microwave oven is operated for long time with a small quantity of food since the temperature of the shaft does not rise to a high level, it is possible to make the shaft with cheap resinous material having a low degree of the thermal resistance thereby decreasing the costs.

Figure 3:
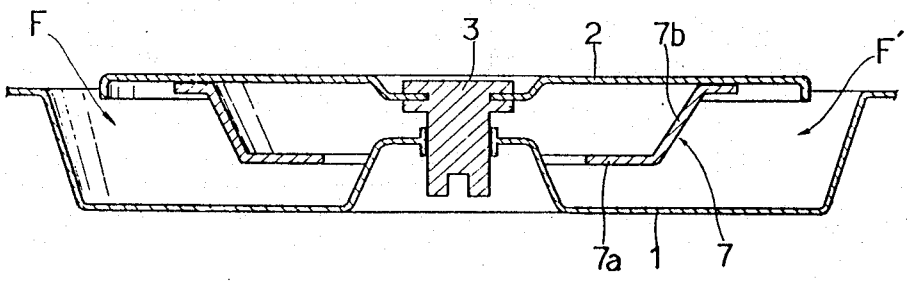
FIG. 3 is a longitudinal sectional view according to another embodiment of the present invention.

FIG. 3 is a sectional view showing another emobidment of the present invention where the protective plate 7 with a horizontal plane 7*a* and an inclined plane 7*b* at the lower surface of the turntable 2 is fixed in an annular manner around the shaft 3 so that the functions of the choke and supplementary cavities are performed as described above. Thus, this embodiment of the present invention also has an advantage in that it functions to protect the shaft 3 making it possible to use a shaft 3 molded out of cheap resinous material having low thermal resistance.

As described above, the present invention applies the $\lambda/4$ characteristic that the microwaves are reflected at a point where the impedance is minimum, while passing through a point where the impedance is maximum. According to the preferred embodiments of the present invention, the shapes of the protective plates are not limited to the above-described embodiments of the present invention, but it is possible to modify then in various ways within the spirit and scope of the claims set forth below.

What is claimed is:

1. In a microwave oven having a heating chamber, a base plate and a turntable mounted on a turntable shaft, the turntable shaft being rotatably mounted on the baseplate and being constructed of a resinous material, a device for protecting the turntable shaft comprising:

protection means connected to the turntable, for preventing microwaves from concentrating around the turntable shaft;

said protection means including, a choke cavity having a first inlet, said first inlet having a minimum impedance, with respect to the microwaves, thereby reflecting the microwaves at said first inlet, and a supplemental cavity having a second inlet, said second inlet having a maximum impedance with respect to the microwaves, thereby absorbing the microwaves at said second inlet.

2. The device as claimed in claim 1, wherein said choke cavity has a length of substantially a half wavelength, the wavelength being the wavelength of the microwave being used in the microwave oven.

3. The device as claimed in claim 1, wherein said supplemental cavity has a length of substantially a one-quarter wavelength, the wavelength being the wavelength of the microwaves being used in the microwave oven.

4. The device as claimed in claim 1, wherein said protecting means is formed concentrically around the turntable shaft.

5. The device as claimed in claim 1, wherein the resinous material has a low thermal resistance.

6. In a microwave oven having a heating chamber, a base plate, and a turntable mounted on a turntable shaft, the turntable shaft being rotatably mounted on the baseplate and being constructed of a resinous material having a low thermal resistance, a device for protecting the turntable shaft comprising:

protection means, connected to the turntable, for preventing microwaves from concentrating around the turntable shaft;

said protection means having an inlet, said protecting means being constructed such that said inlet simultaneously has a minimum impedance, with respect to the microwaves, and a maximum impedance, with respect to the microwaves, thereby reflecting and absorbing the microwaves.

7. The device as claimed in claim 6, wherein said protecting means is formed concentrically around the turntable shaft; and said protecting means includes, an incline plane connected to the turntable, said incline plane having a degree of incline climbing away from the turntable shaft, and a horizontal plane connected to said incline plane, said horizontal plane having an end that is furthest from the turntable shaft, connected to said incline plane, thereby forming a cavity for reflecting and absorbing the microwaves.

* * * * *